US010337209B2

(12) United States Patent
Chow

(10) Patent No.: US 10,337,209 B2
(45) Date of Patent: Jul. 2, 2019

(54) MOTOR WITH MOUNTED PRINTED CIRCUIT BOARD FOR ELECTRONIC LOCK

(71) Applicant: Leslie Ho Leung Chow, Shilouzhen Panyu District (CN)

(72) Inventor: Leslie Ho Leung Chow, Shilouzhen Panyu District (CN)

( * ) Notice: Subject to any disclaimer, the term of this patent is extended or adjusted under 35 U.S.C. 154(b) by 0 days.

(21) Appl. No.: 15/334,192

(22) Filed: Oct. 25, 2016

(65) Prior Publication Data

US 2018/0112437 A1 Apr. 26, 2018

(51) Int. Cl.

| | |
|---|---|
| ***E05B 47/00*** | (2006.01) |
| ***G07C 9/00*** | (2006.01) |
| ***E05B 67/00*** | (2006.01) |
| *E05B 39/04* | (2006.01) |

(52) U.S. Cl.

CPC ..... *E05B 47/0012* (2013.01); *E05B 67/00* (2013.01); *G07C 9/00174* (2013.01); *G07C 9/00309* (2013.01); *E05B 39/04* (2013.01); *E05B 2047/0058* (2013.01); *E05B 2047/0063* (2013.01); *E05B 2047/0073* (2013.01); *G07C 2009/00404* (2013.01); *G07C 2009/00769* (2013.01)

(58) Field of Classification Search

CPC ..... G07C 9/00309; G07C 2009/00404; E05B 47/0012; E05B 67/383; E05B 2047/0058; E05B 2047/0063; E05B 2047/0073

USPC ..... 70/278.7

See application file for complete search history.

(56) References Cited

U.S. PATENT DOCUMENTS

| | | | | | |
|---|---|---|---|---|---|
| 3,577,133 | A * | 5/1971 | Garfein | G11B 5/825 | 360/99.08 |
| 4,712,398 | A * | 12/1987 | Clarkson | E05B 47/063 | 361/172 |
| 5,140,317 | A * | 8/1992 | Hyatt, Jr. | G07B 15/00 | 235/382 |
| 6,005,487 | A * | 12/1999 | Hyatt, Jr. | G07C 9/00103 | 221/7 |
| 6,109,774 | A * | 8/2000 | Holmes | G07F 11/62 | 221/12 |
| 6,588,243 | B1 * | 7/2003 | Hyatt, Jr. | E05B 47/0002 | 70/278.1 |
| 7,099,474 | B1 * | 8/2006 | Liden; Inge | G07C 9/00309 | 235/382 |
| 7,869,155 | B1 * | 1/2011 | Wong | G11B 5/59638 | 360/75 |
| 8,141,399 | B2 * | 3/2012 | Hyatt, Jr. | E05B 47/063 | 340/5.2 |
| 8,850,858 | B2 * | 10/2014 | Nave | E05B 67/22 | 70/21 |
| 8,949,975 | B2 * | 2/2015 | Le | G06F 21/78 | 713/182 |

(Continued)

*Primary Examiner* — Suzanne L Barrett

(74) *Attorney, Agent, or Firm* — John R. Ross; John R. Ross, III

(57) ABSTRACT

A motor for an electronic lock. The motor drives the electronic lock between a locked position and an unlocked position. A printed circuit board is mounted onto the motor. The printed circuit board includes a motor battery that is mounted onto the printed circuit board. A lock memory device is also mounted onto the printed circuit board and keeping a record of the usage of the electronic lock. In a preferred embodiment, the motor battery is remotely mounted and is connected to the printed circuit board via a wire connection.

6 Claims, 10 Drawing Sheets

(56) References Cited

U.S. PATENT DOCUMENTS

| | | | | |
|---|---|---|---|---|
| 9,071,173 | B2 * | 6/2015 | Tsuchiya | G02B 26/122 |
| 9,617,757 | B2 * | 4/2017 | Lowder | E05B 63/08 |
| 9,725,929 | B2 * | 8/2017 | Picard | E05B 63/08 |
| 2002/0134120 | A1 * | 9/2002 | Davis | E05B 17/2092 70/278.3 |
| 2004/0021550 | A1 * | 2/2004 | Ohtaki | H04B 13/005 340/5.31 |
| 2005/0199019 | A1 * | 9/2005 | Marcelle | E05B 47/0012 70/38 A |
| 2008/0141743 | A1 * | 6/2008 | Andersson | E05B 47/063 70/283 |
| 2009/0184822 | A1 * | 7/2009 | Mahaffey | E05B 73/0005 340/568.1 |
| 2011/0067465 | A1 * | 3/2011 | Luo | E05B 47/063 70/278.7 |
| 2011/0203331 | A1 * | 8/2011 | Picard | E05B 9/02 70/91 |
| 2014/0168939 | A1 * | 6/2014 | Rodriguez | B60K 35/00 362/23.09 |
| 2015/0184423 | A1 * | 7/2015 | Chen | E05B 47/0611 70/344 |
| 2016/0145904 | A1 * | 5/2016 | Lowder | E05B 63/08 340/542 |
| 2016/0281389 | A1 * | 9/2016 | Chow | E05B 47/0611 |

* cited by examiner

MOTOR WITH MOUNTED PRINTED CIRCUIT BOARD FOR ELECTRONIC LOCK

The present invention relates to locking devices, and in particular, to motors for electronic locking devices.

BACKGROUND OF THE INVENTION

Prior Art Electromechanical Locking Devices

Electromechanical locking devices are known and include electrically interfaced or controlled release mechanisms for operating a lock cylinder. For example, U.S. Pat. No. 4,712,398 discloses an electronic locking system comprising a lock cylinder with a rotatable plug located therein. An electronically activated release assembly is provided which selectively disengages a locking pin from the plug to allow turning of the key to rotate the plug relative to the cylinder. The lock cylinder and key each include an electronic memory device containing keying system codes. Upon insertion of the key the release mechanism disengages the locking pin from the plug to allow its rotation.

One benefit of including electronic control features in locks is that an electronic record can be kept of lock usage. Also, electronic control features in locks provides for the ability to have increased keying codes for operating the lock. For example, information can be stored in the lock and/or key such that the locking mechanism is activated in response to detecting and/or exchanging data. As the information stored in the components may be altered, it is possible to vary the keying codes without changing the system hardware. In contrast, changing the mechanical keying codes in a purely mechanical lock typically requires forming a new key with different biting surfaces, a more involved process than reprogramming electronic components of an electromechanical lock.

A disadvantage of prior art electronic locking devices is that the lock batteries will eventually deplete and fail. When this occurs the user is forced to utilize a mechanical backup key to open the lock. Once the user starts to utilize the mechanical backup key, an accurate electronic record of the lock usage (i.e., the audit trail) is compromised and lost. Even though the user should immediately replace the depleted battery, instead, it is very common for the user to go for an extended period of time utilizing the backup mechanical key so that the audit trail becomes ever more continuingly flawed.

What is needed is an improved motor for an electronic lock that allows for the lock to be utilized and the audit trail uninterrupted and maintained even after lock battery failure.

SUMMARY OF THE INVENTION

The present invention provides a motor for an electronic lock. The motor drives the electronic lock between a locked position and an unlocked position. A printed circuit board is mounted onto the motor. The printed circuit board includes a motor battery that is mounted onto the printed circuit board. A lock memory device is also mounted onto the printed circuit board and keeping a record of the usage of the electronic lock. In a preferred embodiment, the motor battery is remotely mounted and is connected to the printed circuit board via a wire connection.

DETAILED DESCRIPTION OF THE PREFERRED EMBODIMENTS

First Preferred Embodiment

Figure 4:
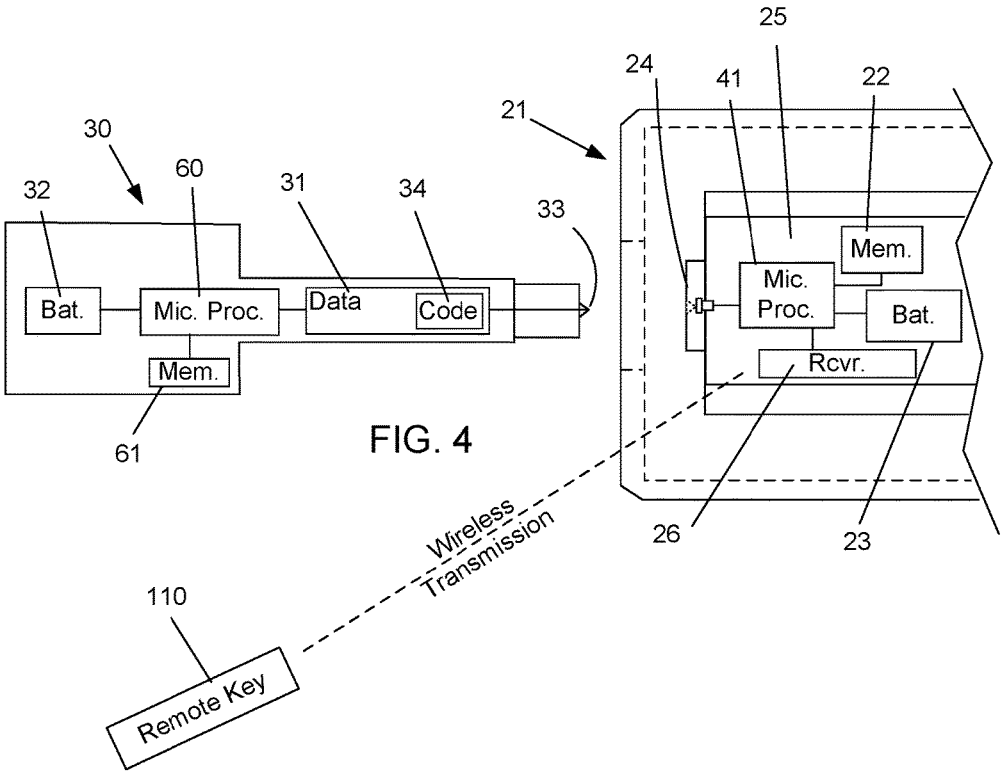
FIG. 4 shows a preferred electronic key and electronic lock.

A preferred embodiment of the present invention includes lock 21 having DC motor 10 (FIGS. 1B-2B) and printed circuit board (PCB) 25. Lock 21 can be used in a variety of lock hardware devices and is very compact. Lock 21 can be controlled through direct contact via an electronic key or with a remote electronic key utilizing protocol such as near-field communication (NFC) and radio frequency identification (RFID), and Bluetooth (FIG. 4). Lock 21 includes an internal battery 23. In the event of a depleted lock battery 23, key battery 32 may provide power. Furthermore, the audit trail is backed up and maintained in key 30. Lock 21 utilizes motor 10 to unlock and then utilizes a return bias spring to return to a locked position.

FIGS. 1A-3 show a first preferred embodiment of the present invention. Lock 21 includes upper housing 20 covering battery powered DC motor 10. Printed Circuit Board (PCB) 25 is rigidly connected to motor 10. Motor 10 functions to rotate shaft 11. In a preferred embodiment DC motor 10 is a 3.7 volt general DC motor. Shaft 11 is connected to gear box 12 of motor 10. Gear box 12 is rigidly connected to motor 10 and includes gearing to effectuate the rotation of shaft 11. Set screw 13 is threaded through lower housing 14 so that set screw 13 presses tightly against shaft 11, thereby preventing rotation of shaft 11.

Return springs 15 are rigidly connected to lower housing 14 at one end and connected to plunger 16 at the other end. Drive pin 17 is rigidly connected to gear box 12 and extends downward from gear box 12 (FIGS. 1B and 2B) and presses against plunger 16 (FIGS. 1A and 2A).

Unlocking the Lock

Figure 1A:
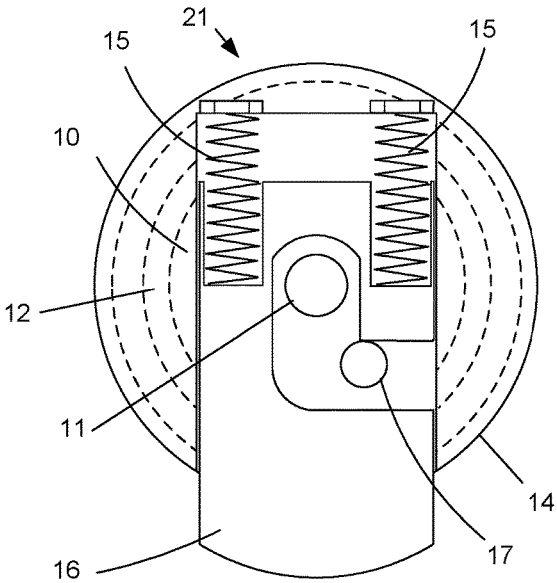
FIGS. 1A-3 show a preferred embodiment of the present invention.
Figure 2A:
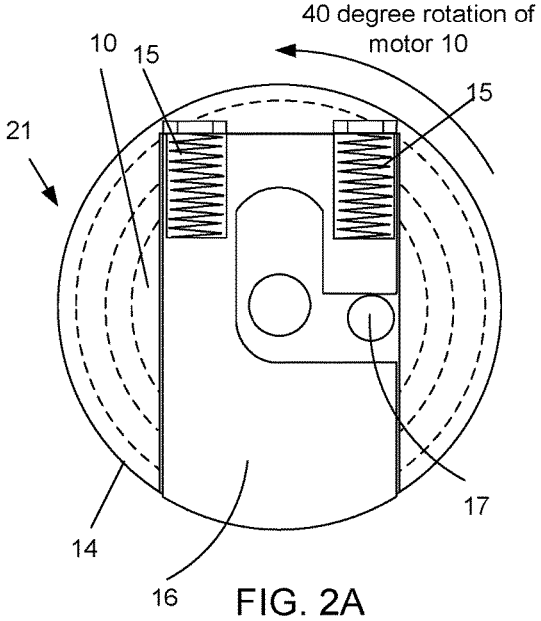
Figure 1B:
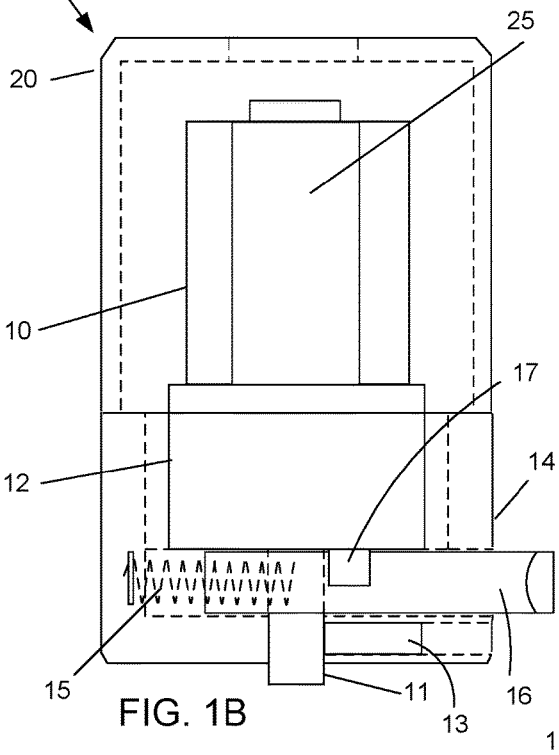

FIGS. 1A and 1B shows lock 21 in a locked position with plunger 16 extended outward beyond the surface of lower housing 14.

To unlock lock 21 the user inserts key 30 into lock 21 as shown in FIG. 4. A key specific ID code 34 identifying key 30 is stored in database 31. Key 30 is powered by battery 32. Microprocessor 60 includes programming to transfer the key's ID code 34 through contact tip 33 to lock 21 when key 30 is inserted into the lock. Lock 21 includes contact pin 24, microprocessor 41, memory 22, wireless signal receiver 26 and battery 23. Microprocessor 41 includes programming to receive ID code 34 and compare it against a list of acceptable codes stored in memory 22. If ID code 34 does not match an acceptable code, then microprocessor 21 will not transfer power to motor 10 and lock 21 will remain locked. However, if ID code 34 is verified, then microprocessor 41 will allow power to be transmitted from battery 23 to motor 10 to rotate shaft 11. The user will then be able to open lock 21.

Figure 2B:
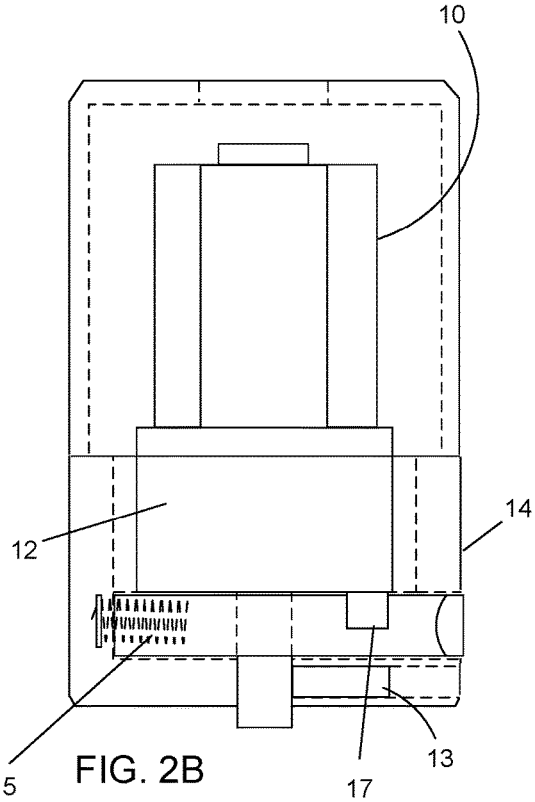
Figure 3:
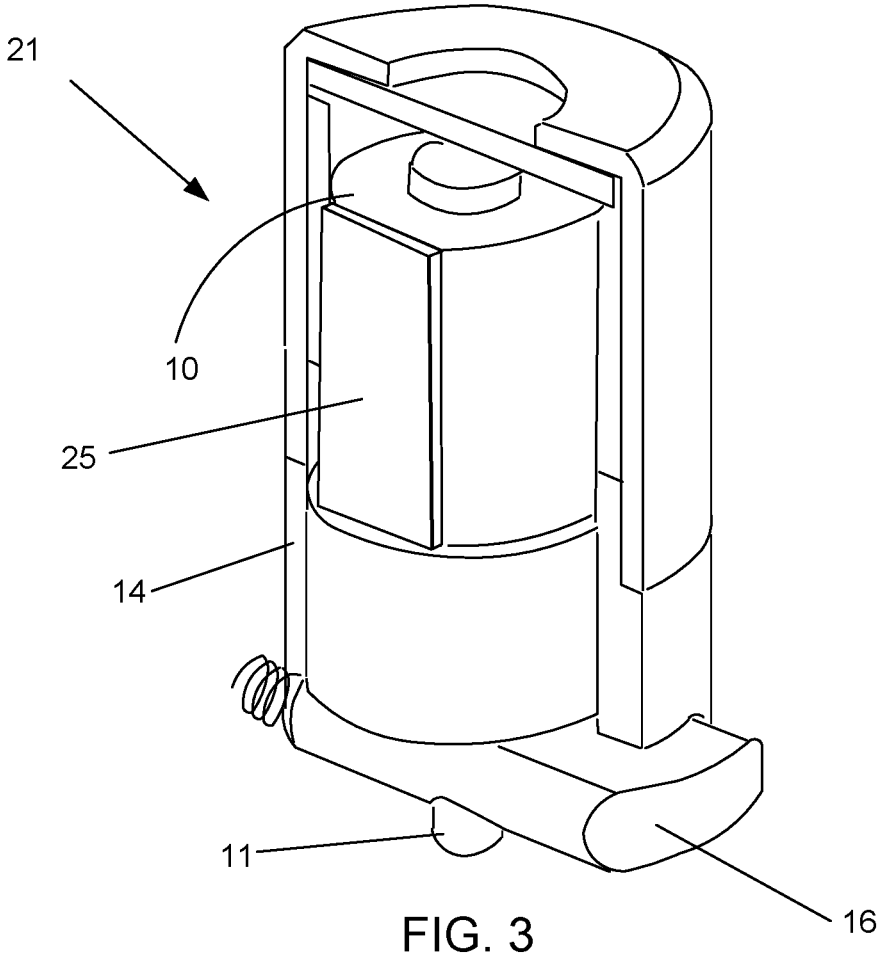

For example, FIGS. 2A and 2B show the position of plunger 16 after the user has inserted key 30 into lock 21 as shown in FIG. 4. After key 30 has been inserted into lock 21, motor 10 has rotated approximately 40 degrees counterclockwise as shown. Drive pin 17 is rigidly connected to gear box 12 and has also rotated approximately 40 degrees counterclockwise, thereby pushing plunger 16 so that it is flush with the surface of lower housing 14. Return springs 15 are compressed as shown. Lock 21 is now unlocked and the user can now have access as desired.

Locking the Lock

Lock 21 is locked again when key 30 is removed so that contact tip 33 is no longer in contact with contact pin 24 (FIG. 4). For example, when key 30 has been pulled away from lock 21, microprocessor 41 is programmed to break the power connection from battery 23 to motor 10. Once battery power is removed from motor 10, return springs 15 will push plunger 16 so that it extends beyond the surface of lower housing 14 as shown in FIGS. 1A and 1B, thereby placing lock 21 in a locked position as shown.

Audit System

In a preferred embodiment, all lock opening and closing events are recorded in lock memory device 22. In this fashion, a complete record can be maintained and audited so that it is always known which key was used to open lock 21 and when lock 21 was accessed. Also, in a preferred embodiment the audit record maintained in lock memory device 22 is transferred to key lock memory device 61 whenever contact is made between contact tip 33 and contact pin 24.

Battery Depletion/Failure of the Lock's Battery

In the event battery 23 fails, microprocessor 60 is programmed to transfer power from key battery 32 to motor 10 so that the device may be easily opened and accessed. Concurrently, the audit information maintained on memory device 22 is not lost and is transferred to key memory device 61 so that all audit information is kept. Battery 23 can then be replaced with a new battery without any disruption to the audit trail.

Other Preferred Embodiment

Figure 5:
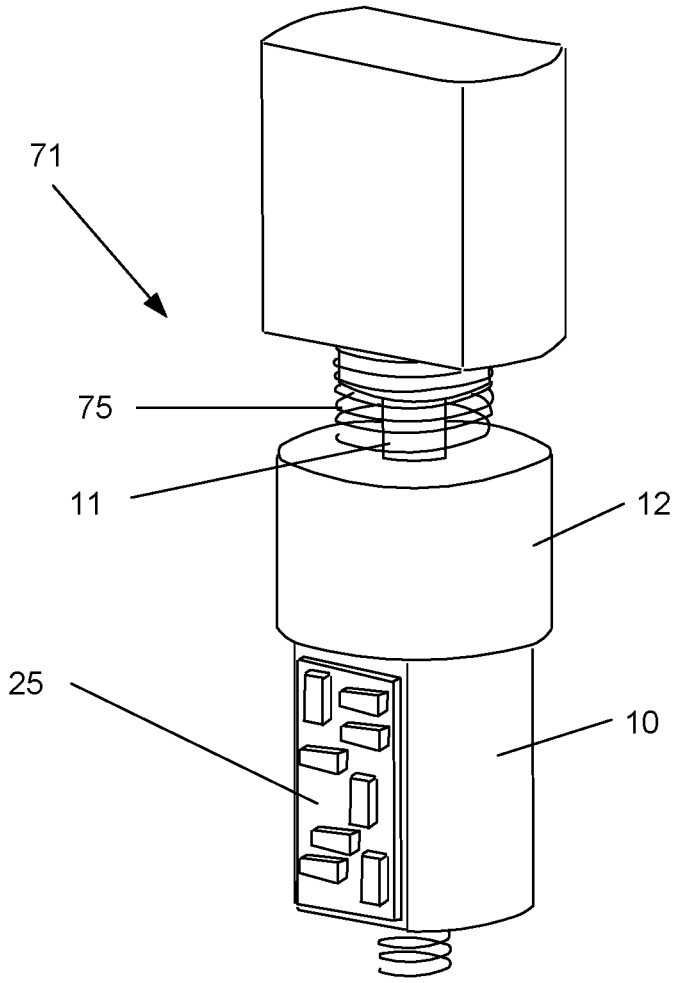
FIGS. 5-7 show another preferred embodiment of the present invention.
Figure 6:
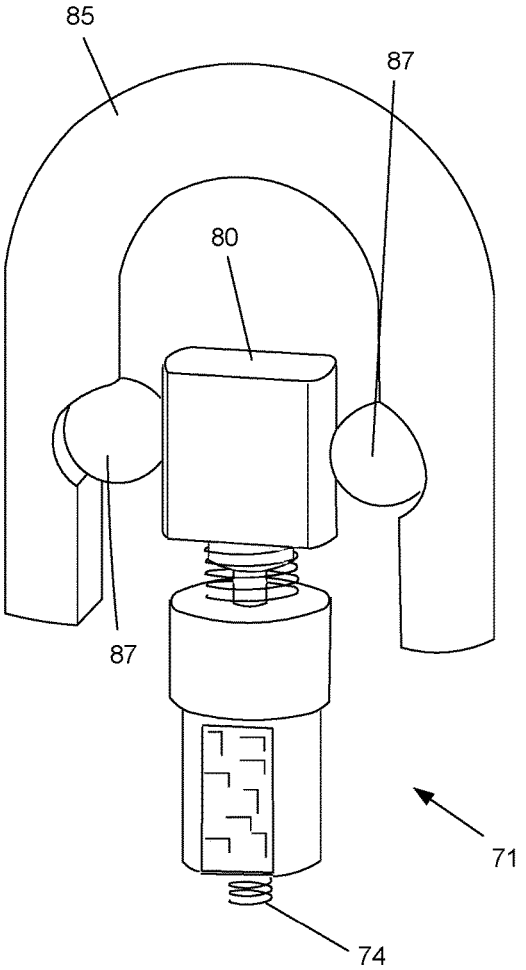
Figure 7:
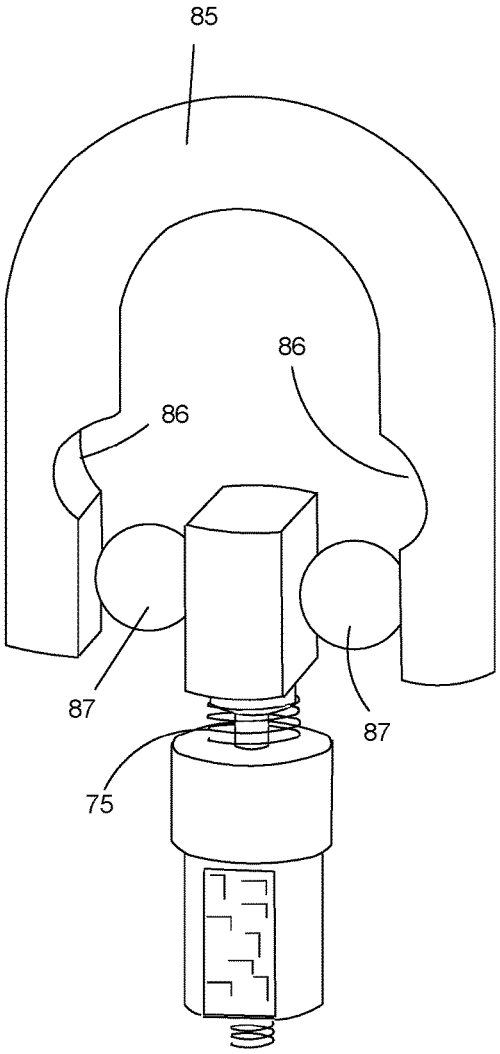
Figure 9:
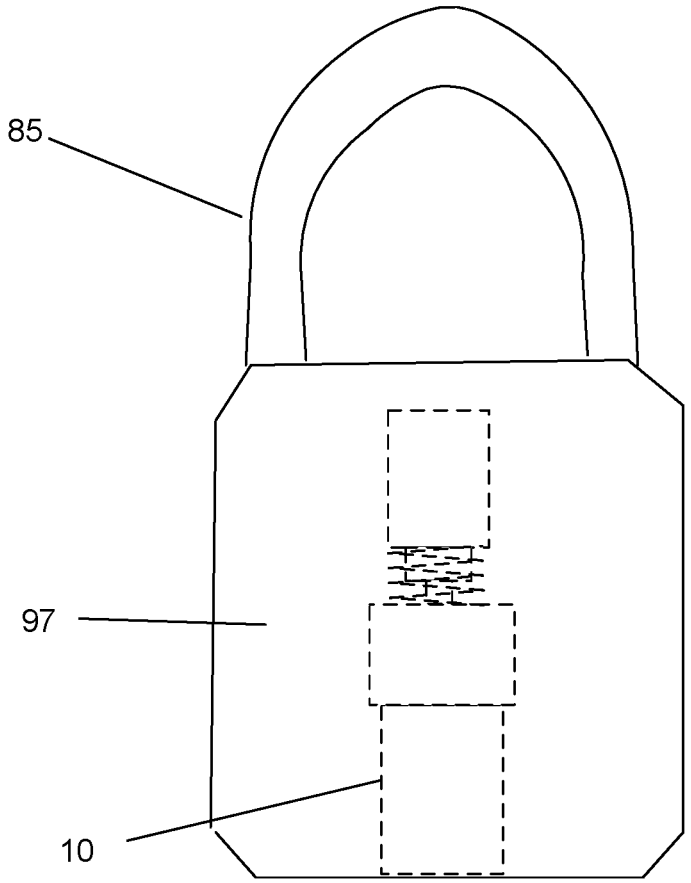
FIG. 9 shows a preferred lock.
Figure 10:
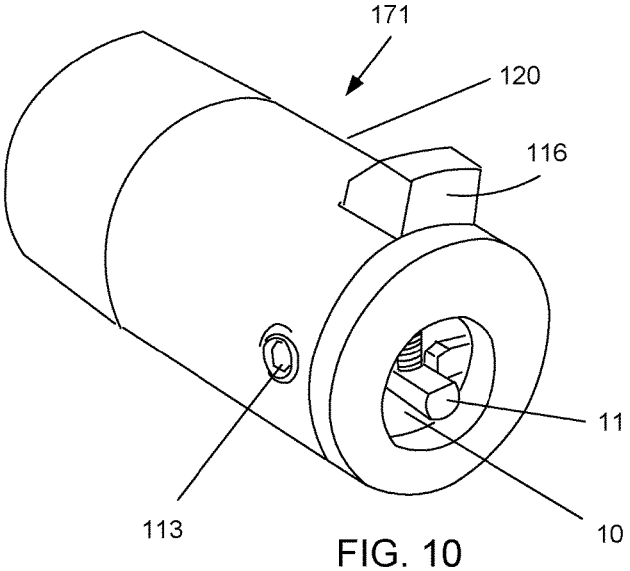
FIG. 10-14 shows another preferred embodiment of the present invention.
Figure 11:
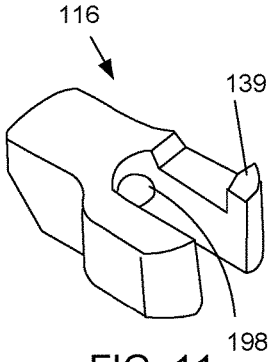

Another preferred embodiment of the present invention is shown in FIGS. 5-7. Lock 71 includes battery powered DC motor 10. Printed Circuit Board (PCB) 25 is rigidly connected to motor 10. Motor 10 is rigidly connected to the lock housing (i.e., padlock body 97) (FIG. 9). Motor 10 functions to rotate shaft 11. Shaft 11 is connected gear box 12 of motor 10. Gear box 12 is rigidly connected to motor 10 and includes gearing to effectuate the rotation of shaft 11. Return spring 75 is connected to gear box 12 at one end and to cam drive 80 at its other end.

Unlocking the Lock

FIG. 6 shows lock 71 in a locked position with balls 87 held in place by cam 80 so as to lock shackle 85.

Figure 8:
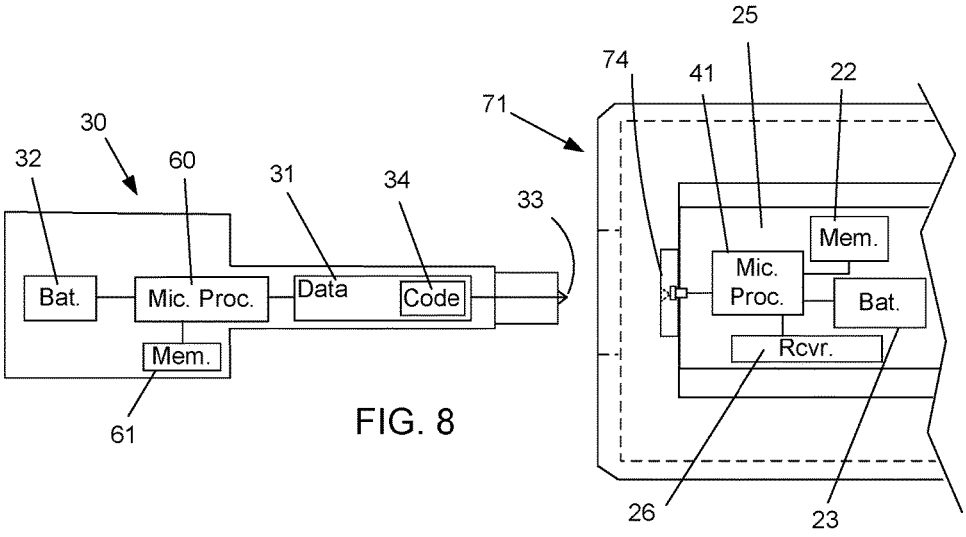
FIG. 8 shows another preferred key and lock.

To unlock lock 21 the user inserts key 30 (FIG. 4) into lock 71 so that contact tip 33 makes contact with contact pin 74 (FIG. 8). As with the earlier preferred embodiment, lock 71 includes PCB 25. A key specific ID code 34 identifying key 30 is stored in database 31. Key 30 is powered by battery 32. Microprocessor 60 includes programming to transfer the key's ID code 34 through contact tip 33 to lock 71 when key 30 is inserted into the lock. Lock 71 includes contact pin 74, microprocessor 41, memory 22, wireless signal receiver 26 and battery 23. Microprocessor 41 includes programming to receive ID code 34 and compare it against a list of acceptable codes stored in memory 22. If ID code 34 does not match an acceptable code, then microprocessor 41 will not transfer power to motor 10 and lock 21 will remain locked. However, if ID code 34 is verified, then microprocessor 41 will allow power to be transmitted from battery 23 to motor 10 to rotate shaft 11. The user will then be able to open lock 21.

For example, FIG. 7 shows the position of cam 80 after the user has inserted key 30 into lock 21 as shown in FIG. 4. After key 30 has been inserted into lock 71, shaft 11 has rotated approximately 90 degrees as shown. Cam 80 is now perpendicular to shackle 85, thereby permitting balls 86 to leave grooves 87 of shackle 85. Return spring 75 is compressed as shown. Lock 21 is now unlocked and the user can raise shackle 85 and have access as desired.

Locking the Lock

Lock 21 is locked again when key 30 is removed so that contact tip 33 is no longer in contact with contact pin 74 (FIG. 8). For example, when key 30 has been pulled away from lock 71, microprocessor 41 is programmed to break the power connection from battery 23 to motor 10. Once battery power is removed from motor 10, return spring 75 will rotate shaft 11 so that cam 80 is flush with shackle 85, thereby pushing balls 87 back into grooves 86 of the shackle and placing lock 71 in the locked position as shown in FIG. 6.

Other Preferred Embodiment

FIGS. 10-14 show another preferred embodiment of the present invention. Lock 171 includes housing 120 covering battery powered DC motor 10. Printed Circuit Board (PCB) 25 is rigidly connected to motor 10, as shown in above preferred embodiments. Motor 10 functions to rotate shaft 11. Set screw 113 (FIG. 10) is threaded through lower housing 120 so that set screw 113 presses tightly against shaft motor 10 so as to hold motor 10 rigid with respect to housing 120. Return spring 115 is positioned between shaft 11 recess 198 of plunger 116. Drive pin 117 is rigidly threaded into shaft 11 and extends upward from shaft 11.

Unlocking the Lock

Figure 12:
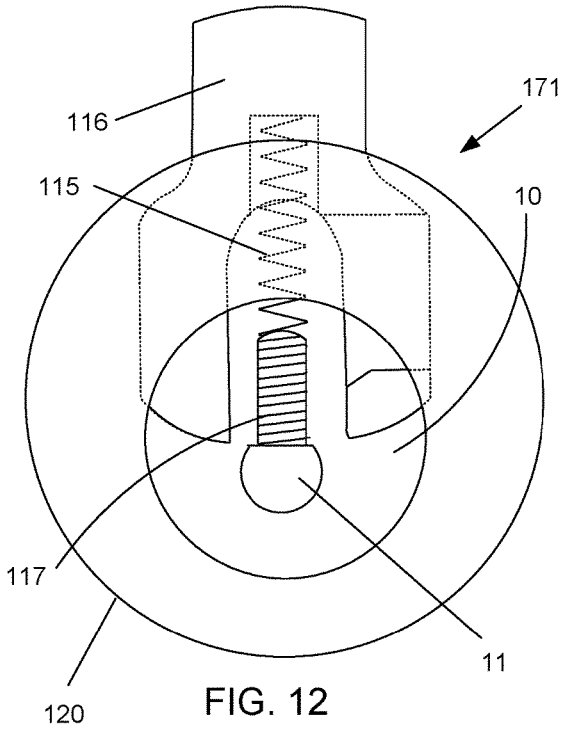

FIG. 12 shows lock 171 in a locked position with plunger 116 extended outward beyond the surface of housing 120.

To unlock lock 21 the user inserts key 30 into lock 171 in a fashion similar to that described above in reference to the earlier preferred embodiments.

Figure 13:
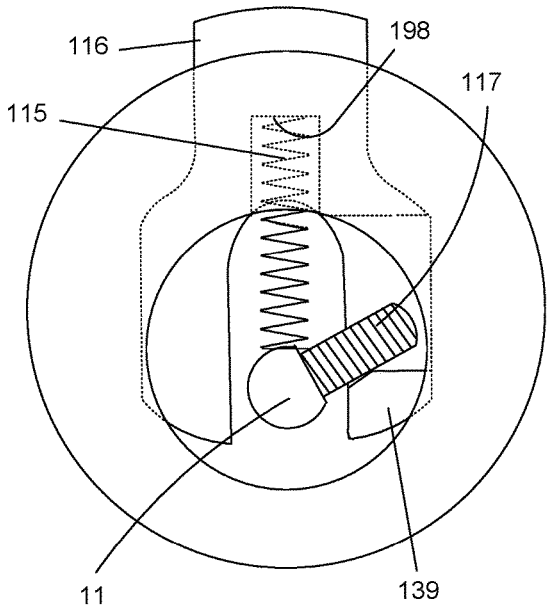

For example, in FIG. 13 the user has inserted key 30 into lock 171 and shaft 11 has begun its clockwise rotation as shown. Drive pin 117 has contacted knob 139 of plunger 116 and is forcing plunger 116 downward. Return spring 115 is compressing as shown.

Figure 14:
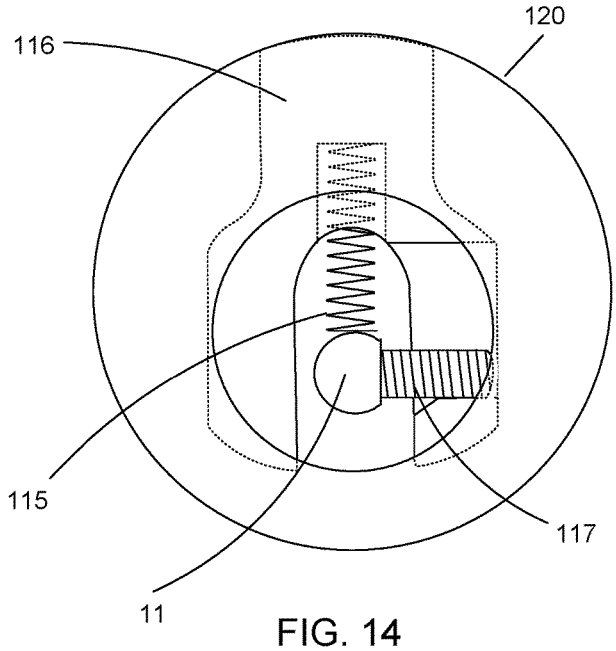

In FIG. 14, shaft 11 has rotated approximately 90 degrees and drive pin 117 has forced plunger 116 fully downward so that it is flush with housing 120 so that lock 171 is now unlocked.

Locking the Lock

Lock 21 is locked again when key 30 is removed so that it is no longer in contact with lock 171. Once battery power is removed from motor 10, return springs 115 will push plunger 116 so that it extends beyond the surface of housing 120 as shown in FIG. 12, thereby placing lock 171 in a locked position as shown.

Other Preferred Embodiment

Figure 15:
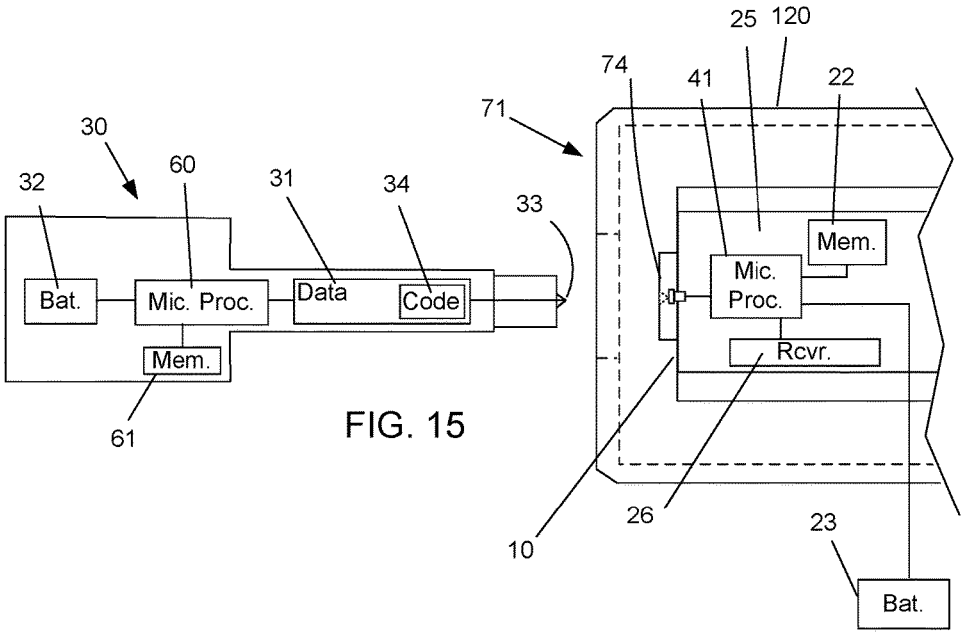
FIG. 15 shows another preferred embodiment of the present invention.

FIG. 15 shows another preferred embodiment of the present invention. In FIG. 15, motor battery 23 is connected to PCB 25 via a wire connection. This preferred embodiment because it allows battery 23 to be remotely connected, thereby freeing up space on PCB 25. This enables motor 10 to more easily fit into housing 120.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A lock system comprising a motor for an electronic lock, wherein said motor is for driving said electronic lock between a locked and unlocked position, said lock system comprising:

A. a printed circuit board mounted onto said motor,

B. a motor battery electrically connected to said printed circuit board and for providing power to said motor, and C. a lock memory device mounted on said PCB and for recording a record of said electronic lock usage, D. a return spring for returning said electronic lock to a locked position, and E. an electronic key, comprising:

i. a key battery for providing power to said electronic key and said electronic lock, and ii. a key memory device for recording a record of said electronic lock usage, wherein said key battery provides power to said electronic lock by having physical contact with said electronic lock in the event of said motor battery failure, and wherein said key memory device records a backup recording of said electronic lock usage in the event of said motor battery failure.

2. The lock system as in claim 1, wherein said motor battery is remotely mounted and connected to said printed circuit board via a wire connection.

3. The lock system as in claim 1, further comprising:

A. a rotatable shaft controllable by said motor,

B. a lock housing,

C. a device for locking said shaft to said lock housing,

D. a drive pin rigidly connected to said motor,

E. a plunger controllable by said drive pin, and wherein said return spring is connected to said housing at one end and connected to said plunger at another end, wherein said plunger is driven by said drive pin so that said plunger is flush with said housing when said electronic lock is unlocked.

4. The lock system as in claim 1 wherein said motor further comprises a wireless transmission receiver mounted on said printed circuit board for receiving lock commands from a wireless remote electronic key.

5. A lock system comprising a motor for an electronic lock, wherein said motor is for driving said electronic lock between a locked and unlocked position, said lock system comprising:

A. a printed circuit board mounted onto said motor,

B. a motor battery electrically connected to said printed circuit board and for providing power to said motor, C. a lock memory device mounted on said PCB and for recording a record of said electronic lock usage, D. a rotatable shaft controllable by said motor, E. a lock housing wherein said motor is rigidly connected to said lock housing, F. a cam rigidly connected to said rotatable shaft, and G. a return spring for returning said electronic lock to a locked position, wherein said return spring is connected to said motor at one end and connected to said cam at another end, wherein said cam is driven by said motor to place said electronic lock in said unlocked position.

6. A lock system comprising a motor for an electronic lock, wherein said motor is for driving said electronic lock between a locked and unlocked position, said lock system comprising:

A. a printed circuit board mounted onto said motor,

B. a motor battery electrically connected to said printed circuit board and for providing power to said motor, C. a lock memory device mounted on said PCB and for recording a record of said electronic lock usage, D. a rotatable shaft controllable by said motor, E. a lock housing, F. a device for locking said motor to said lock housing, G. a drive pin rigidly connected to said rotatable shaft, H. a plunger controllable by said drive pin, and I. a return spring for returning said electronic lock to a locked position, wherein said return spring is adjacent to said shaft at one end and connected to said plunger at another end, wherein said plunger is driven by said drive pin so that said plunger is flush with said housing when said electronic lock is unlocked.

* * * * *